US005930733A

United States Patent [19]

Park et al.

[11] Patent Number: 5,930,733

[45] Date of Patent: Jul. 27, 1999

[54] STEREOPHONIC IMAGE ENHANCEMENT DEVICES AND METHODS USING LOOKUP TABLES

[75] Inventors: Byung-Chul Park, Kyungki-do; She-Woong Jeong; Soon-Koo Kweon, both of Seoul; Tae-Sun Kim, Incheon-si; Yang-Ho Kim, Kyungki-do, all of Rep. of Korea

[73] Assignee: Samsung Electronics Co., Ltd., Rep. of Korea

[21] Appl. No.: 08/824,152

[22] Filed: Mar. 25, 1997

[30] Foreign Application Priority Data

Apr. 15, 1996 [KR] Rep. of Korea ..... 96-11244

[51] Int. Cl.[6] ..... H04R 5/04

[52] U.S. Cl. ..... 702/76; 702/75; 702/194; 381/1; 381/17; 381/18; 381/19

[58] Field of Search ..... 702/39, 48, 54, 702/56, 66, 67, 70, 71, 73–76, 79, 80, 89, 106, 124–126, 189, 190, 194; 324/76.19, 22; 369/5, 1, 2, 4, 86, 88, 89, 91; 381/1, 17–19, 103, 98, 61; 704/205, 229, 230, 235, 504, 220

[56] References Cited

U.S. PATENT DOCUMENTS

| | | | |
|---|---|---|---|
| 4,074,083 | 2/1978 | Berkovitz et al. | 369/88 |
| 4,866,774 | 9/1989 | Klayman | 381/1 |
| 5,381,482 | 1/1995 | Matsumoto et al. | 381/1 |
| 5,386,082 | 1/1995 | Higashi | 381/17 |
| 5,524,053 | 6/1996 | Iwamatsu | 381/17 |
| 5,633,938 | 5/1997 | Porter, III | 381/1 |
| 5,642,423 | 6/1997 | Embree | 381/19 |
| 5,757,927 | 5/1998 | Gerzon et al. | 381/19 |

*Primary Examiner*—Hal Dodge Wachsman
*Attorney, Agent, or Firm*—Myers Bigel Sibley & Sajovec

[57] ABSTRACT

A stereophonic image may be enhanced by splitting the left and right input audio signals into a plurality of left and right output signals in a plurality of audio frequency bands and then generating left and right output audio signals from the left and right output signals based on the magnitude of the differences between corresponding left and right output signals and also based upon the absolute magnitude of the left and right input audio signals themselves. In particular, a stereophonic image enhancement device according to the invention processes a left input signal and a right input signal using a first spectrum analyzer and a second spectrum analyzer which output a plurality of left output signals and right output signals corresponding to a plurality of frequency bands in response to the corresponding left input signal and right input signal. A table lookup signal is responsive to the plurality of left output signals and to the plurality of right output signals to output a plurality of left output signal pairs and a plurality of right output signal pairs. A first and second adder are responsive to the plurality of left output signal pairs and right output signal pairs respectively to add the output signal pairs and produce final left output signals and right output signals respectively.

19 Claims, 8 Drawing Sheets

STEREOPHONIC IMAGE ENHANCEMENT DEVICES AND METHODS USING LOOKUP TABLES

FIELD OF THE INVENTION

The present invention relates to stereophonic devices and methods, and more particularly to stereophonic image enhancement devices and methods.

BACKGROUND OF THE INVENTION

Generally, stereophonic signals include a left channel input signal and a right channel input signal. A sum signal is obtained by adding the two signals whereas a difference signal is obtained by subtracting one signal from the other.

It is known to use sound retrieval systems (SRS) to retrieve sound more closely resembling an original sound, to generate three dimensional sound images using two speakers and to expand the audible area regardless of input signals of either mono, stereo or encoded surround sound. According to the fundamental principle of SRS, a three dimensional signal and directional cues of an audio system are provided through the process of treating direct sound and centralized sound such as dialogue, vocalist and soloist, from the sum signal (L+R), and ambiance signals such as reflective sound and reverberation.

In other words, SRS is a sound treatment technique based on the human hearing system and may be distinguished from a conventional stereo system or a sound expansion technique. Therefore, SRS may not need such operations as time delay, phase shift, and encoding or decoding.

Another characteristic feature of conventional SRS is that it is generally not affected by the position of speakers, thereby enabling three dimensional stereo sound, similar to a live performance, regardless of a listener's position. When a stereo microphone is used for recording, it may be difficult for a certain frequency such as that of side sound to be properly retrieved because the microphone does not respond to the frequency in the same way as human ears. However, the SRS can reproduce the frequency and the ratio of direct sound and indirect sound so that a listener can hear sounds quite close to the original.

As shown in FIG. 1, an SRS generally includes stereo image enhancement means 10 and perspective correction means 30. Each of these means can also be used as an independent SRS. The stereo image enhancement means 10 receives a left input sound signal $L_{in}$ and a right input sound signal $R_{in}$ and, after selective enhancement, outputs a first left signal $L_{out1}$ and a first right signal $R_{out1}$. The perspective correction means 30 receives the output signals $L_{out1}$ and $R_{out1}$ from the stereo image enhancement means 10 and, after correcting the signals toward the direction of sound source regardless of the position of the speakers, outputs a second left signal $L_{out2}$ and a second right signal $R_{out2}$.

Thus, as shown in FIG. 1, a stereophonic device using conventional SRS comprises stereo image enhancement means 10 for outputting first audio signals to the left $L_{out1}$ and to the right $R_{out1}$ after first receiving audio input signals from the left $L_{in}$ and from the right $R_{in}$, then enhancing a difference signal of the two input signals. The stereophonic device also comprises perspective correction means 30 for outputting second audio signals to the left $L_{out2}$ and to the right $R_{out2}$ after receiving the first audio signals $L_{out1}$ and $R_{out1}$ from the stereo image enhancement means 10, then correcting the signals toward the direction of sound source regardless of the position of the speakers.

In the stereo image enhancement means 10, as shown in FIG. 2, a first high-pass filter 11 receives a left input sound signal $L_{in}$ and a second high-pass filter 12 receives the right input sound signal $R_{in}$. Both input signals are filtered through 30 kHz high-pass filters 11 and 12 so that the audio system can be protected from excessive low frequency energy which may occur due to a physical impact.

A first adder 13 receives and adds the output signals from the first high-pass filter 11 and the second high-pass filter 12, generating a sum signal (L+R). A first subtracter 14 receives the output signals from the first high-pass filter 11 and the second high-pass filter 12, generating a difference signal (L−R). In such a manner, the sum signal (L+R) or the difference signal (L−R) is formed from the two input signals after passing through the high-pass filters 11 and 12.

The difference signal (L−R) is input to a spectrum analyzer 15 which includes, for example, seven band-pass filters. The spectrum analyzer 15 classifies the frequency of the difference signal (L−R) into 7-bands and outputs them.

The dynamic sum signal equalizer 17, after receiving the sum signal (L+R) and the output signal from the spectrum analyzer 15, outputs a sum signal $(L+R)_p$ which is equalized by the equalizing control signal X1. The dynamic difference signal equalizer 18, after receiving the difference signal (L−R) and the output signal from the spectrum analyzer 15, outputs a difference signal $(L-R)_p$ which is equalized by the equalizing control signal X1.

Each of the 7-band output signals from the spectrum analyzer 15, after passing through an internal rectifying circuit and buffer, is input to a dynamic sum signal equalizer 17 and to a dynamic difference signal equalizer 18 as a control signal. Each of the dynamic equalizers 17 and 18 also includes seven band-pass filters which are characterized by the output signal from the spectrum analyzer 15.

The band-pass filters accentuate a low-frequency component in comparison to a high-frequency component. As a result, a signal of the dynamic difference equalizer 18 at same band frequency is attenuated according to the scale of output signal from the band-pass filter of the spectrum analyzer 15. For the sum signal (L+R), a large component of the difference signal (L−R) may be amplified more than a small component, resulting in an increase of the difference between the large component and the small component to effect enhancement of stereo image through successive processes thereafter. Each of the band-pass filters of the spectrum analyzer 15 and of the dynamic equalizers 17 and 18 preferably includes seven intervals per octave. Frequencies in the middle of the intervals are 125 Hz, 250 Hz, 500 Hz, 1 kHz, 2 kHz, 4 kHz and 8 kHz.

A fixed equalizer 19 receives the difference signal $(L-R)_p$ from the dynamic difference signal equalizer 18 and outputs an attenuated signal in the band from 1 kHz to 4 kHz. Inadequate accentuation of the signals may be prevented at the frequency band from 1 kHz to 4 kHz which is a sensitive region to human ears.

A control circuit 16 receives the sum signal (L+R) from the first adder 13, the difference signal (L−R) from the first subtracter 14 and the feedback control signal X3, and then controls the sum signal (L+R) and the processed difference signal $(L-R)_p$ to a certain ratio. Thus, artificial reverberation may be prevented from erroneously boosting and outputting an equalizing control signal X1 and multiplying control signal X2.

In other words, if artificial reverberation is regarded as a small difference signal (L−R), the signal at the same band may be amplified to generate unpleasant sound. When the scale of the processed difference signal $(L-R)_p$ exceeds a predetermined ratio even though the sum signal (L+R) is large enough, the difference signal may be regarded as an artificial reverberation and may be controlled continuously. Such control may be carried out restrictively for the frequency band of 500 Hz, 1 kHz and 2 kHz where the frequency of a soloist or vocalist predominates.

A first multiplier 21 multiplies the output signal from the dynamic sum signal equalizer 17 and a first correction factor K1 and outputs the resulting signal. A second multiplier 22 multiplies the output signal from the fixed equalizer 19 and a multiplying control signal X2 and outputs a feedback control signal X3. A third multiplier 23 multiplies the output signal from the second multiplier 22 and a second correction factor K2 and outputs the resulting signal. After the above described operations, the audio signal is further treated by the first correction factor K1 and the second correction factor K2, resulting in a final stereo image enhancement signal.

The operations performed by the stereo image enhancement means 10 as described above can thus be expressed by the following equations:

$$L_{out1}=L_{in}+K1\ (L+R)_p+K2\ (L-R)_p \quad (1)$$

$$R_{out1}=R_{in}+K1\ (L+R)_p+K2\ (L-R)_p \quad (2)$$

In equations (1) and (2), one of the main characteristics of the stereo image enhancement means 10 is that relatively small component of the difference signal (L−R) may be amplified selectively.

A fourth multiplier 24 multiplies the output signal from the third multiplier 23 and −1. A second adder 25 adds the output signals from the first high-pass filter 11, from the first multiplier 21 and from the third multiplier 23 and outputs the resulting left output signal $L_{out1}$. A third adder 26 adds the output signals from the second high-pass filter 12, from the fourth multiplier 24 and from the first multiplier 21 and outputs the resulting right output signal $R_{out1}$.

Thus, as shown in FIG. 2, the stereo image enhancement means 10 comprises: a first high-pass filter 11 for outputting a signal after filtering the input signal $L_{in}$; a second high-pass filter 12 for outputting a signal after filtering the input signal $R_{in}$; a first adder 13 for outputting a sum signal (L+R) after adding both of the output signals from the first high-pass filter 11 and the second high-pass filter 12; and a first subtracter 14 for outputting a difference signal (L−R) after subtracting the output signal of the second high-pass filter 12 from the output signal of the first high-pass filter 11. The stereo image enhancement means 10 also comprises a spectrum analyzer 15 for outputting signals after classifying the frequency of difference signal (L−R) into 7-band; a dynamic sum signal equalizer 17 for outputting a sum signal $(L+R)_p$ after receiving the sum signal (L+R) from the adder 13 and an output signal from the spectrum analyzer 15 which are equalized by an equalizing control signal X1; a dynamic difference signal equalizer 18 for outputting a difference signal $(L-R)_p$ after receiving the difference signal (L−R) from the subtracter 14 and the output signal from the spectrum analyzer 15 which are equalized by the equalizing control signal X1; and a fixed equalizer 19 for receiving the difference signal $(L-R)_p$ from the dynamic difference signal equalizer 18 and attenuating the frequency of the signal in the band from 1 kHz to 4 kHz before outputting the signal.

The stereo image enhancement means 10 also comprises a control circuit 16 for outputting the equalizing control signal X1 and a multiplying control signal X2 after receiving the sum signal (L+R) from the first adder 13, the difference signal (L−R) from the first subtracter 14 and a feedback control signal X3, and then controlling the sum signal (L+R) and the difference signal (L−R) to a certain ratio and preventing artificial reverberation from erroneous boosting; a first multiplier 21 for multiplying a first correction factor K1 and an output signal from the dynamic sum signal equalizer 17; a second multiplier 22 for generating the feedback control signal X3 after multiplying the output from the fixed equalizer 19 and the control signal X2; a third multiplier 23 for multiplying the output from the second multiplier 22 and a second correction factor K2; and a fourth multiplier 24 for multiplying the output from the third multiplier 23 and −1.

The stereo image enhancement means 10 also comprises a second adder 25 for outputting a left signal $L_{out1}$ after adding the output from the first high-pass filter 11, the output from the first multiplier 21 and the output from the third multiplier 23; and a third adder 26 for outputting a right signal $R_{out1}$ after adding the output from the second high-pass filter 12, the output from the fourth multiplier 24 and the output from the first multiplier 21.

The perspective correction means 30 of FIG. 1 will now be described. When a speaker is positioned in the front or at the side like the door speakers of a car, or when a headphone is used, the perspective of side component of sound or central component of sound may be corrected by the perspective correction means.

FIGS. 3A to 3D are curves showing the frequency characteristics corresponding to the positions of a sound source. FIG. 3A shows a curve of the frequency perceived by human ears when the sound source is in the front, and FIG. 3B shows a curve of the frequency when the sound source is at a right angle. As shown, the same level of sound may be perceived differently by human ears according to the position of sound source and the frequency.

FIG. 3C shows a curve of the frequency when the sound source is in the front while the speaker is positioned at the side. For example, when a headphone is used, an equalizer may be necessary for correcting the direction of central sound component or front sound component. FIG. 3D shows, similarly, that an equalizer may be necessary for correcting the side sound component from the front positioned speaker.

Referring to FIG. 4, the performance of perspective correction means 30 will now be described. As shown in FIG. 4, the perspective correction means 30 comprises: a first adder 31 for generating a sum signal (L+R) after adding the left input signal $L_{in}$ or $L_{out1}$ and the right input signal $R_{in}$ or $R_{out1}$; a first subtracter 32 for generating a difference signal (L−R) after subtracting the right input signal $R_{in}$ from the left input signal $L_{in}$; a fixed sum signal equalizer 33 for generating a sum signal $(L+R)_s$ after equalizing the sum signal (L+R); and a fixed difference signal equalizer 34 for generating a difference signal after equalizing the difference signal $(L-R)_s$.

The perspective correction means 30 also includes a first selecting means 35 for selecting either the sum signal (L+R) or the equalized sum signal $(L+R)_s$ in response to a selecting signal S; a second selecting means 36 for selecting either the difference signal (L−R) or the equalized difference signal $(L-R)_s$ in response the selecting signal S; and a first multiplier 37 for multiplying an output signal from the second selecting means 36 and −1. The perspective correction means 30 also includes a second adder 38 for generating a second left output signal $L_{out2}$ after adding output signals from the first selecting means 35 and from the second selecting means 36; and a third adder 39 for generating a second right output signal $R_{out2}$ after adding output signals from the first selecting means 35 and from the first multiplier 37.

The first adder 31 outputs the sum signal (L+R) after adding the left input signal $L_{in}$ or $L_{out1}$ and the right input signal $R_{in}$ or $R_{out1}$. The first subtracter 32 outputs the difference signal (L−R) after subtracting the right input signal $R_{in}$ from the left input signal $L_{in}$. Thus, the sum signal (L+R) or the difference signal (L−R) is generated from the left input signal and the right input signal, which is input to the fixed sum signal equalizer 33 and the fixed difference signal equalizer 34 respectively.

The fixed sum signal equalizer 33 outputs a processed sum signal $(L+R)_s$ after equalizing the inputted sum signal (L+R). The fixed difference signal equalizer 34 outputs a processed difference signal $(L-R)_s$ after equalizing the inputted difference signal (L−R). The characteristic of the fixed sum signal equalizer 33, as shown in FIG. 3C, is that a correction configuration is generally required to compensate the central sound component from the side speaker, whereas the fixed difference signal equalizer 34, as shown in FIG. 3D, generally requires a correction configuration to compensate the side sound component from the front positioned speaker.

The first selecting means 35 is a multiplexer for selecting one of the two input signals, the sum signal (L+R) and the processed sum signal $(L+R)_s$, in response to the selecting signal S. The second selecting means 36 selects either the difference signal (L−R) or the processed difference signal $(L-R)_s$ in response to the selecting signal S.

The first multiplier 37 multiplies the output signal from the second selecting means 36 and −1, outputting the resultant signal. The second adder 38 outputs the second left output signal $L_{out2}$ after adding the output signals from the first selecting means 35 and from the second selecting means 36. The third adder 39 outputs the second right output signal $R_{out2}$ after adding the output signals from the first selecting means 35 and from the first multiplier 37.

Thus, the final output signals, i.e. the second left output signal $L_{out2}$ and the second right output signal $R_{out2}$, are generated through a mixing circuit of the second adder 38 and the third adder 39. The above described process may be expressed by the following equations:

$$L_{out}=(L+R)_s+(L-R)_s \quad (3)$$

$$R_{out}=(L+R)_s-(L-R)_s \quad (4)$$

where $(L+R)_s$ and $(L-R)_s$ respectively represent the sum signal and the difference signal which are processed in the equalizer in response to the selecting signal S.

According to equations (3) and (4), when the selecting signal S selects the first terminal of the first selecting means 35 or the second selecting means 36, the system is configured for compensating the side sound signal from the front speaker, wherein the difference signal $(L-R)_s$ is compensated as shown in FIG. 3D whereas the sum signal $(L+R)_s$ remains untreated because the speaker is in the front. Conversely, when the selecting signal S selects the second terminal of the first selecting means 35 or the second selecting means 36, the system is configured for compensating the front sound signal from the side speaker.

In such an instance, the characteristic of the fixed sum signal equalizer 33 and the fixed difference signal equalizer 34 need not be as accurate as shown in FIG. 3C or 3D. It may be sufficient to equalize only those main frequencies, such as 500 Hz, 1 kHz and 8 kHz, the characteristics of which are listed in the following Table.

TABLE

| MAIN FREQUENCY | DIFF. SIGNAL EQUALIZER | SUM SIGNAL EQUALIZER |
|---|---|---|
| 500 Hz | +5.0 dB | −5.0 dB |
| 1 kHz | +7.7 dB | −7.5 dB |
| 8 kHz | +15.0 dB | −15.0 dB |

In conclusion, the SRS, regardless of the recorded sound source, is capable of retrieving the original stereo image, extending the scope of hearing and recovering the directional cues of the original sound source. In addition, the SRS may be advantageous compared with other sound control systems such as Dolby Prologic which may restrict the sound source or other effect processors which may require additional delay.

SUMMARY OF THE INVENTION

The present invention stems from the realization that in the conventional SRS, the spectrum analyzer as described above, only compares the spectrum of the difference signal for respective frequency band. Therefore an accurate retrieval of 3-dimensional sound may be difficult to achieve. Specifically, a signal at a specific frequency band may be affected not only by the magnitude of corresponding band but also by a signal at another frequency band. It is difficult for the conventional SRS to control those interferences occurring among the different frequency bands.

The present invention also stems from the realization that in conventional SRS, at the same frequency band, control is generally carried out on the basis of the magnitude of difference signal only, without reference to the absolute magnitude of the left signal and the right signal. But in practice, it may be desirable to describe the system as a function of the left signal and the right signal.

For example, assume the magnitude of the difference signal for a set of left and right signals, 50 mV and 40 mV, is equal to the difference signal for another set of left and right signals, 500 mV and 490 mV. Although the magnitude of the difference signals is the same in the example above, the absolute magnitude of each signal is quite different. Accordingly, the characteristics of equalizers should be different and the difference between the two signals should be determined on the basis of the ratio.

The present invention provides enhanced stereophonic devices and methods using a table lookup architecture, wherein the status or the change of an input signal may be accurately perceived and stereo image enhancement and perspective correction can be achieved reliably. Since a table lookup is used, stereophonic devices can be programmable to satisfy a variety of users' tastes and requirement of convenience.

In particular, stereophonic image enhancement devices according to the present invention process a left input signal and a right input signal. A first spectrum analyzer outputs a plurality of left output signals for a corresponding plurality of frequency bands in response to the left input signal. A second spectrum analyzer outputs a plurality of right output signals for a corresponding plurality of frequency bands, in response to the right input signal.

A table lookup system is also included which is responsive to the plurality of left output signals to output a plurality of left output signals pairs, and which is also responsive to the plurality of right output signals to output a plurality of right output signal pairs. A first adder is responsive to the plurality of left output signal pairs, to add the plurality of left output signal pairs to produce final left output signals. A second adder is responsive to the plurality of right output signal pairs to add the plurality of right output signal pairs to produce the final right output signals.

By using a table lookup, greater flexibility may be obtained and control may be carried out based on the absolute magnitude of the left signal and the right signal, not only the magnitude of the difference signal. The lookup table can also be programmed in response to user input to satisfy a user's tastes and other considerations.

The first and second spectrum analyzers may use frequency bands which are proportional to human hearing sensitivity, for example where the hearing sensitivity is lowest at about 3 kHz. The lookup table system preferably includes a plurality of lookup tables which are divided in accordance with respective frequencies and are further divided into a plurality of subtables according to the amplitude of the respective frequency bands.

A particular embodiment of a lookup table system comprises a memory which includes a plurality of row address lines and column address lines, which are responsive to the plurality of right output signals and left output signals, respectively. The memory includes a plurality of cells which store a plurality of parameters. The cell's output parameters are stored therein in response to column address lines and row address lines. An interpolating system includes four interpolators which output interpolated parameters in response to the parameters which are received from the memory. A first multiplier multiplies the left input signal and the output signal from the first interpolator. A second multiplier multiplies the left input signal and the output signal from the second interpolator. A third multiplier multiplies the right input signal and the output signal from the third interpolator. A fourth multiplier multiplies the right input signal and the output signal from the fourth interpolator. A first adder adds the output signals from the first multiplier and from the third multiplier, and a second adder adds the output signals from the second multiplier and from the fourth multiplier.

The table lookup system is preferably responsive to the plurality of left and right output signals in accordance with a logarithmic correlation between sound pressure level and perception level. In order to save memory space, the lookup table may be responsive to a selected one of the left output signals and the right output signals in the same frequency band. Alternatively, the lookup table may be responsive to selected ones of the left output signals and the right output signals in the same frequency band and in frequency bands which are adjacent the same frequency band.

In another embodiment, the interpolator system also includes a fifth interpolator and a sixth interpolator. A fifth multiplier multiplies an output of the sixth interpolator and an output of the first adder to produce a right output signal pair and a sixth multiplier multiplies an output of the fifth interpolator and an output of the second adder to produce a left output signal pair. The outputs from the fifth interpolator and the sixth interpolator may produce delay parameters for time delay. The delay parameters may be used to control the time difference of the signal's arrival to each human ear, so that sound localization may be achieved.

In another embodiment, stereophonic image enhancement devices also include a third adder which is responsive to the final left output signal from the first adder and the left output signal to add a predetermined ratio of the left input signal to the final left output signal. A fourth adder is also included which is responsive to the final right output signal from the second adder and to the right input signal, to add a predetermined ratio of the right input signal to the final right output signal.

Stereophonic image enhancing methods according to the present invention may be used to enhance a stereophonic image from left and right input audio signals. The input signals are classified into respective frequency bands to provide a plurality of right output signals and left output signals in the plurality of frequency bands. A table lookup is performed to obtain a plurality of left output signal pairs and right output signal pairs, using the left output signals and the right output signals to address the table. The left output signal pairs are added to produce a final left output signal and the right output signal pairs are added to produce a final right output signal. The lookup table preferably contains weight parameters and delay parameters.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 5:
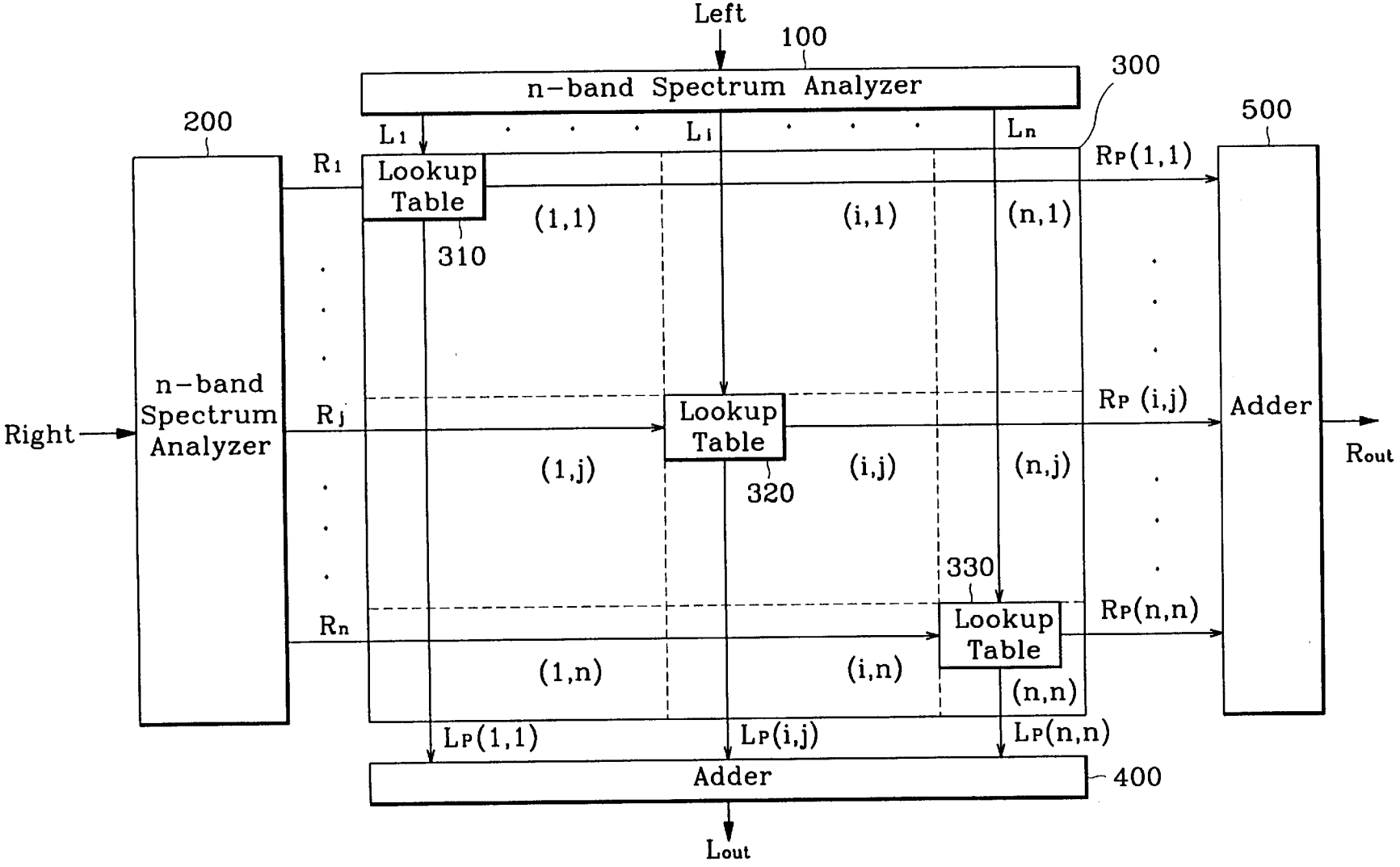
FIG. 5 is a block diagram illustrating a stereophonic device having a table lookup architecture according to an embodiment of the present invention.

Referring to FIG. 5, a stereophonic device according to an embodiment of the present invention includes a first spectrum analyzer 100 which outputs a plurality of left output signals L1, L2, . . . Ln after receiving a left input signal, and classifying the left input signal into respective frequency bands. A second spectrum analyzer 200 outputs a plurality of right output signals R1, R2, . . . Rn after receiving a right input signal and classifying the right input signal into respective frequency bands. A table lookup system or architecture 300 preferably includes a plurality of lookup tables 310, 320 and 330 which output a plurality of left output signal pairs Lp(1,1), . . . Lp(i,j), . . . Lp(n,n) and a plurality of right output signal pairs Rp(1,1), . . . Rp(i,j), . . . Rp(n,n) after processing the plurality of left output signals L1, L2, . . . Ln and right output signals R1, R2, . . . Rn from the spectrum analyzers using predetermined parameters.

A first adder 400 outputs a final left output signal $L_{out}$ after receiving and selectively adding the left output signal pairs Lp(1,1), . . . Lp(i,j) . . . Lp(n,n) among a plurality of output signals from the lookup tables 310, 320 and 330. A second adder 500 outputs a final right output signal $R_{out}$ after receiving and selectively adding the right output signal pairs Rp(1,1), . . . Rp(i,j) . . . Rp(n,n) among a plurality of output signals from the lookup tables 310, 320 and 330.

Figure 7:
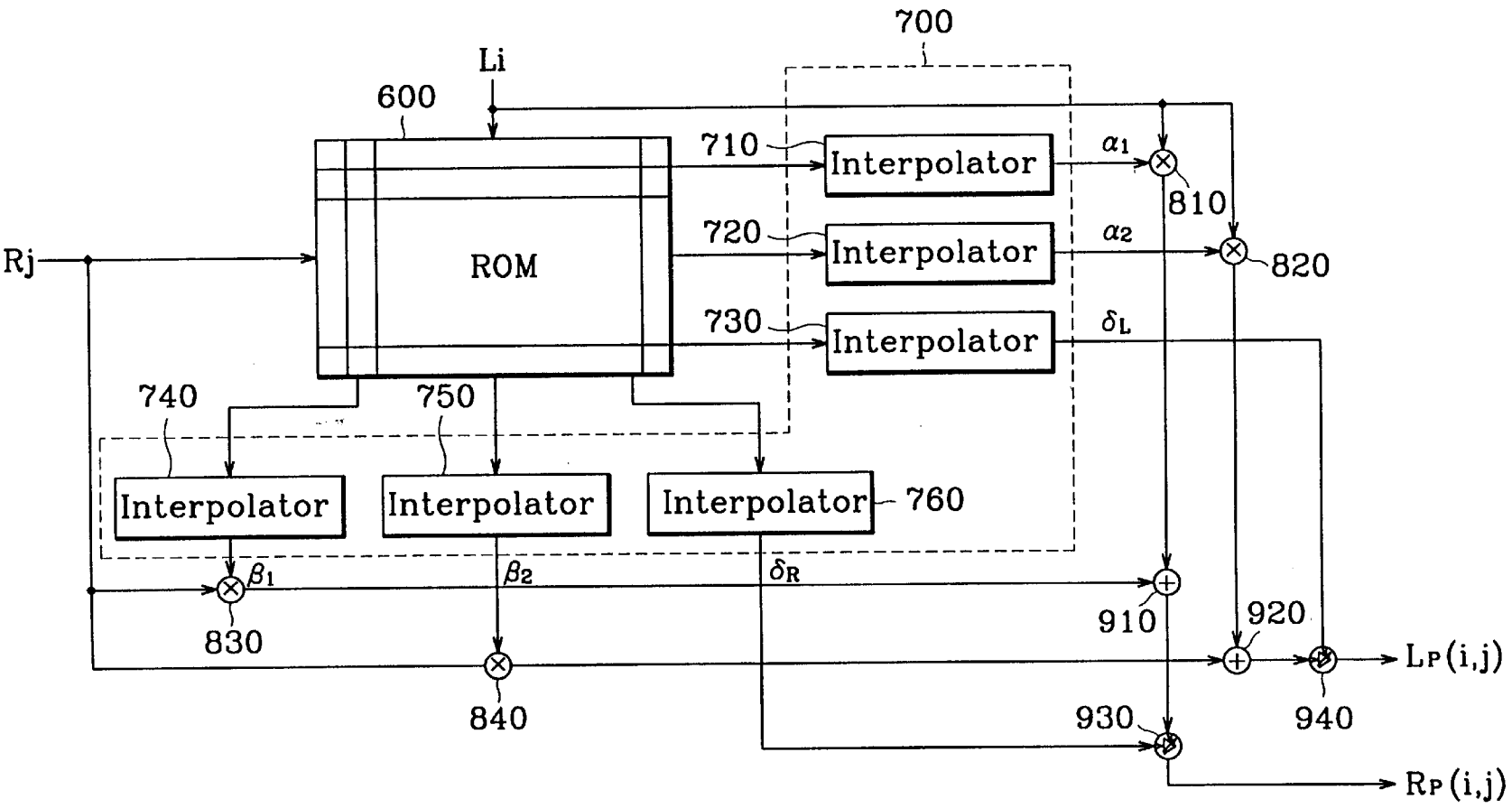
FIG. 7 is a block diagram illustrating a lookup table block according to an embodiment of the present invention.

Referring to FIG. 7, each of the lookup tables 310, 320 and 330 preferably includes memory 600 which includes a plurality of cells having a plurality of parameters. The memory outputs six parameters $\alpha 1'$, $\alpha 2'$, $\beta 1'$, $\beta 2'$, $\delta_L'$ and $\delta_R'$ stored in the corresponding cell in response to a column address line and a row address line which may be obtained by converting respective output signals Li and Rj from the spectrum analyzers 200 and 300 into a logarithmic scale. An interpolator system 700 including six interpolators 710, 720, 730, 740, 750 and 760, outputs interpolated parameters $\alpha 1$, $\alpha 2$, $\beta 1$, $\beta 2$, $\delta_L$ and $\delta_R$ in response to the parameters $\alpha 1'$, $\alpha 2'$, $\beta 1'$, $\beta 2'$, $\delta_L'$ and $\delta_R'$ which are output from the memory means 600.

A first multiplier 810 outputs $\alpha 1 \cdot Li$ after multiplying the left input signal Li and the output signal $\alpha 1$ from the first interpolator 710. A second multiplier 820 outputs $\alpha 2 \cdot Li$ after multiplying the left input signal Li and the output signal $\alpha 2$ from the second interpolator 720. A third multiplier 830 outputs $\beta 1 \cdot Rj$ after multiplying the right input signal Rj and the output signal $\beta 1$ from the fourth interpolator 740. A fourth multiplier 840 outputs $\beta 2 \cdot Rj$ after multiplying the right input signal Rj and the output signal $\beta 2$ from the fifth interpolator 750.

A first adder 910 adds the output signals from the first multiplier 810 and from the third multiplier 830. A second adder 920 adds the output signals from the second multiplier 820 and from the fourth multiplier 840. A fifth multiplier 930 outputs a right output signal pair Rp(i,j) after delaying the output time of the first adder 910 by means of the output signal $\delta_R$ from the sixth interpolator 760. A sixth multiplier 940 outputs a left output signal pair Lp(i,j) after delaying the output time of the first adder 920 by means of the output signal $\delta_L$ from the third interpolator 730.

Figure 10:
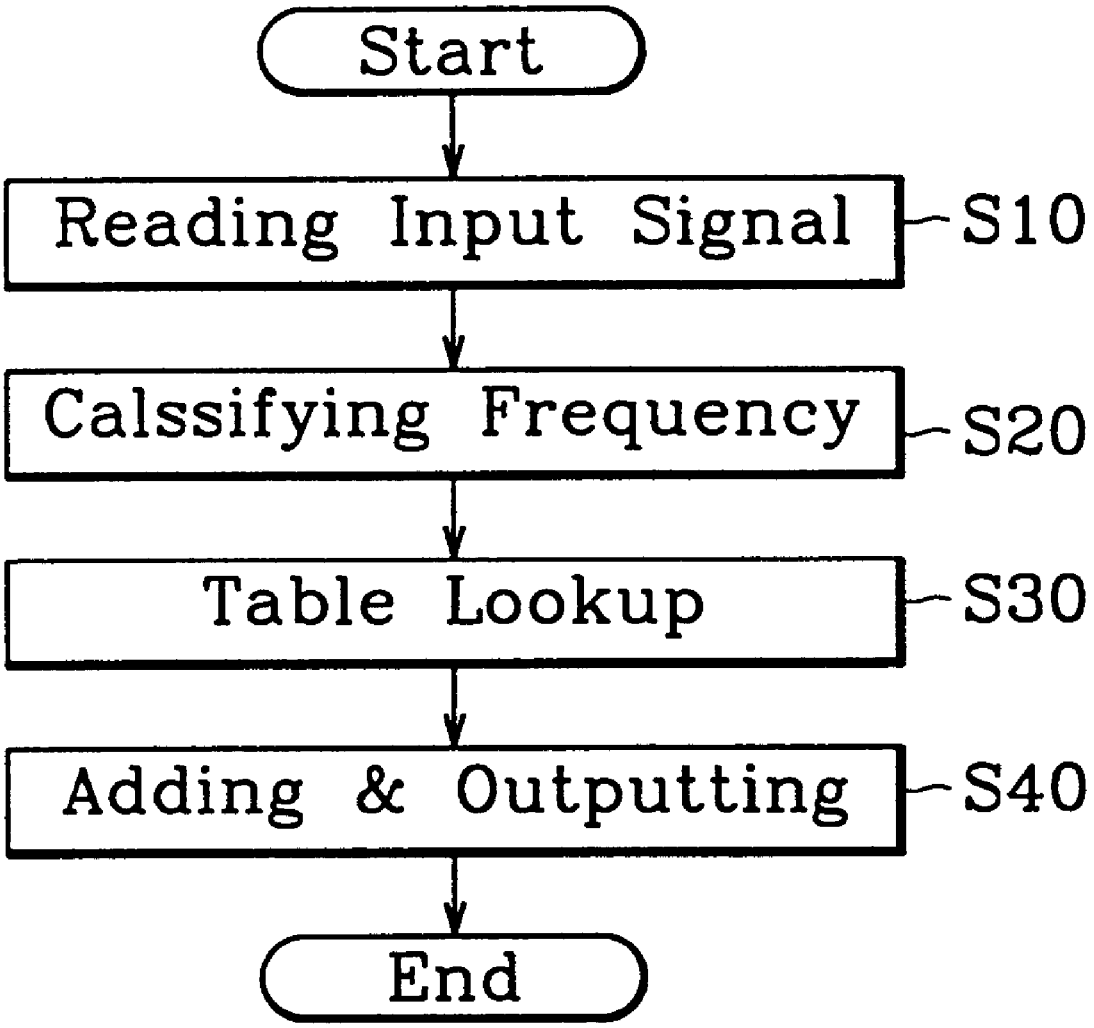
FIG. 10 is a flow chart illustrating operations of stereophonic devices according to an embodiment of the present invention.

Referring to FIG. 10, according to method aspects of the present invention, the left input signal and the right input signal which are audio signals are read at Block S10. The frequencies of the input signals are classified into respective frequency bands by means of a spectrum analyzer and thereafter a plurality of right output signals and left output signals are produced (Block S20).

A table lookup (S30) is performed to output a plurality of left output signal pairs and right output signal pairs after receiving the left output signals and the right signals from the classifying block and then interpolating using a plurality of weight parameters and delay parameters which are predetermined in the lookup table.

Adding and outputting is performed at Block S40 to add left output signal pairs from the table lookup block to output a left output signal, and to add right output signal pairs from the table lookup block, thereby outputting a right output signal.

The lookup table is a tool used in digital technology, wherein digital data is stored in a memory and the data value of a corresponding address is output in response to an input signal. For example, input signals are classified by a spectrum analyzer and, according to each of the classified frequencies, the data value of a corresponding address is output. The table lookup architecture also provides an operational method for a system by using the lookup table.

In a stereo system using the table lookup architecture, input stereo audio signals are represented by left input signals and right input signals which are classified into respective frequency bands after being treated in an n-band spectrum analyzer. The classified left signal and right signal form a paired signal which is input to the lookup table block and then output after being treated by a parameter stored in the lookup table. The output signals from the lookup table are aggregated to either left or right, thereby forming the final left output signal or the final right output signal.

Referring to FIG. 5, the operations which are performed on the signals in the stereophonic device using the table lookup architecture will now be described: The first spectrum analyzer 100 receives the left input signals and classifies them into corresponding frequency bands and outputs a plurality of left output signals L1, L2, . . . Ln. The second spectrum analyzer 200 receives the right input signals and classifies them into corresponding frequency bands and outputs a plurality of right output signals R1, R2, . . . Rn.

The function of the first spectrum analyzer 100 and the second spectrum analyzer 200 is to classify the left input signal and the right signal into respective frequency bands. In case of the left input, the signals are classified into the frequency band from the first left input L1 to the n-th left input Ln. In the same manner, the right input signals are classified from the first right input R1 to the n-th right input signal Rn, wherein the i-th left input signal Li of the first spectrum analyzer 100 and the i-th right input signal Ri of the second spectrum analyzer 200 are in the same frequency band. If a higher i value is assumed to give a higher frequency band of the i-th input signals, Li and Ri, the quality of signal processing may be improved, although the hardware cost may increase along with the increased n value.

Figure 1:
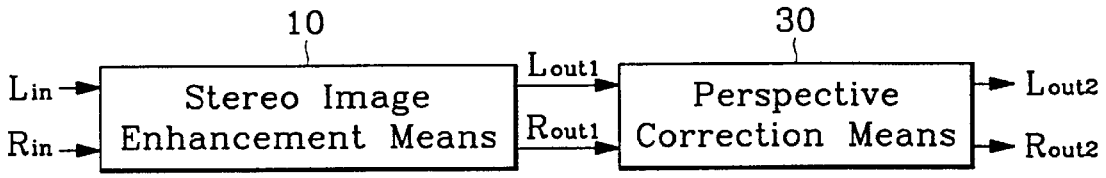
FIG.1(Prior Art)
FIG. 1 is a block diagram illustrating a stereophonic device which uses a conventional sound retrieval system (SRS).
Figure 4:
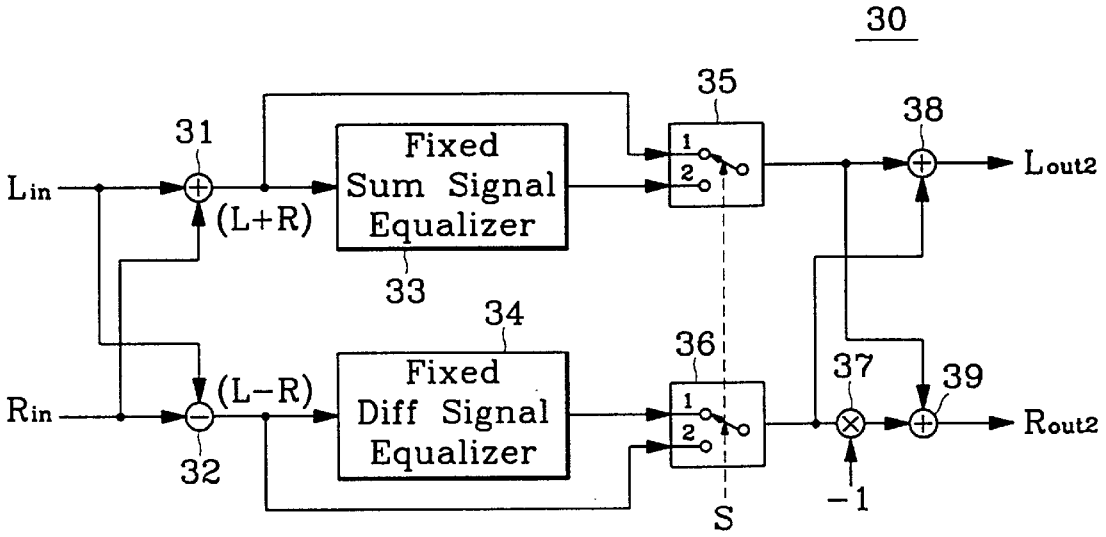
FIG.4(Prior Art)
FIG. 4 is a block diagram illustrating the perspective correction means of the conventional SRS of FIG. 1.
Figure 2:
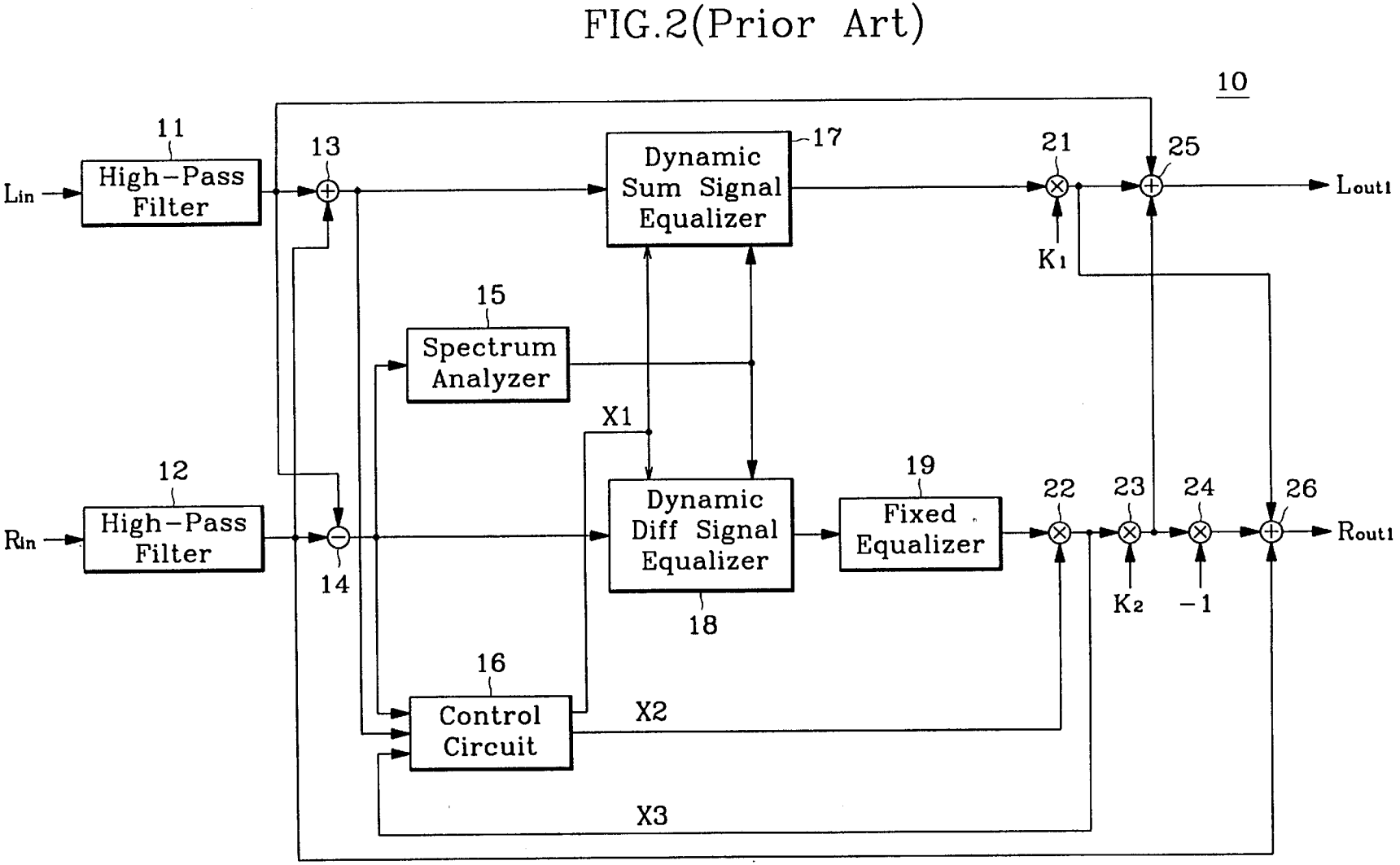
FIG.2(Prior Art)
FIG. 2 is a block diagram illustrating the stereo image enhancement means of the conventional SRS of FIG. 1.
Figure 3A:
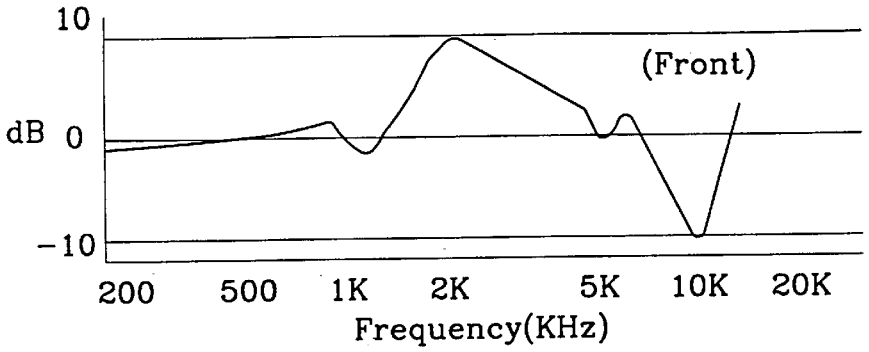
FIG.3A(Prior Art)
FIG. 3A graphically illustrates conventional frequency response characteristics when human hearing is in the front.
Figure 3B:
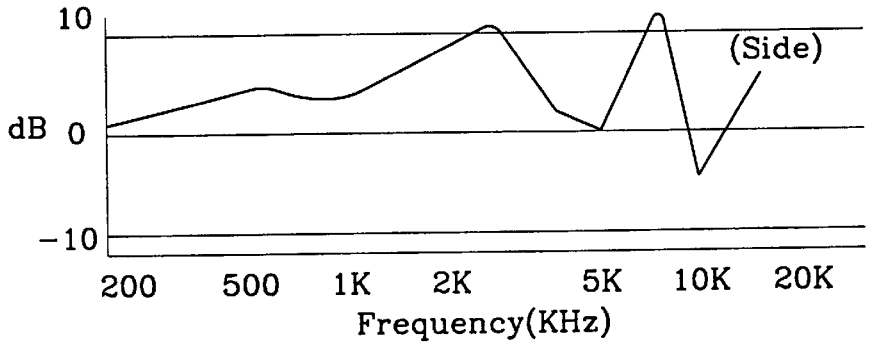
FIG.3B(Prior Art)
FIG. 3B graphically illustrates conventional frequency response characteristics when human hearing is in the side.
Figure 3C:
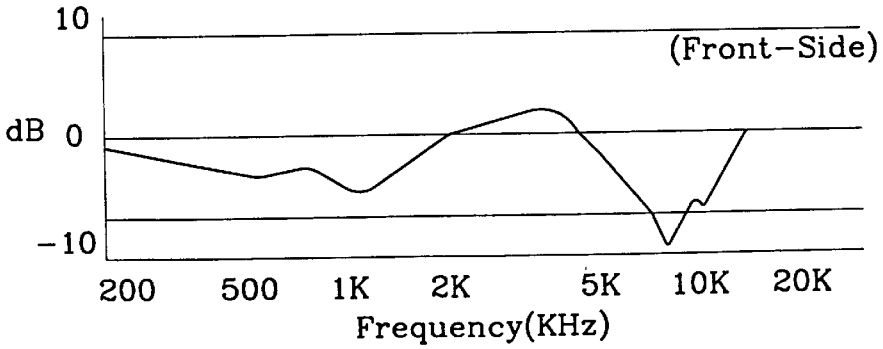
FIG.3C(Prior Art)
FIG. 3C graphically illustrates conventional frequency response characteristics when human hearing is in the front-side.
Figure 3D:
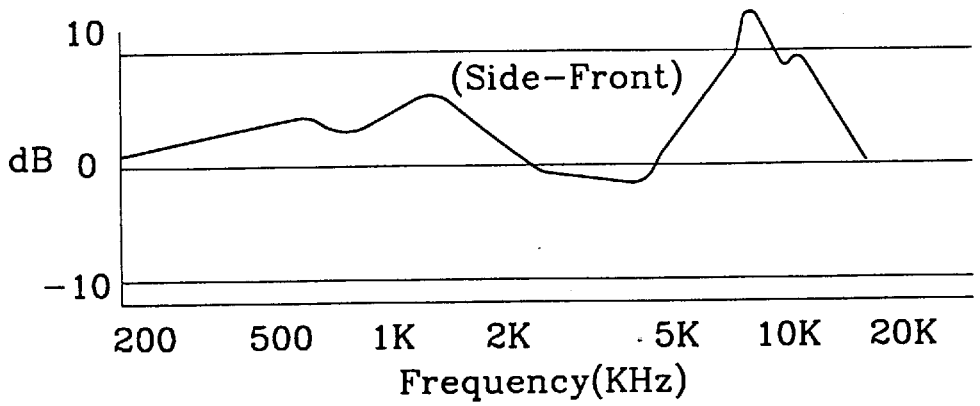
FIG.3D(Prior Art)
FIG. 3D graphically illustrates conventional frequency response characteristics when human hearing is in the side-front.
Figure 6:
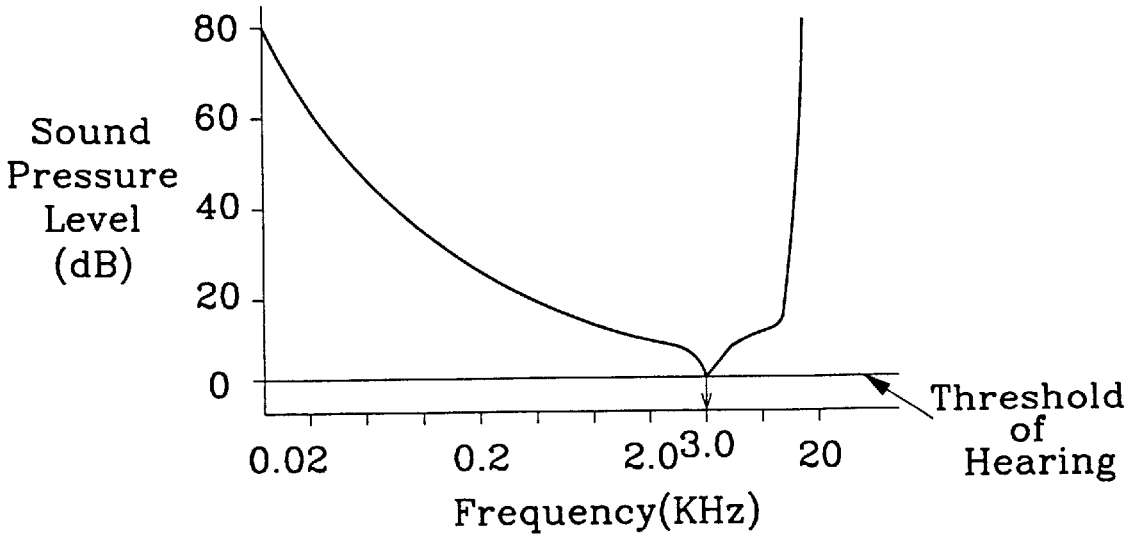
FIG. 6 graphically illustrates characteristics of human hearing sensitivity in general.

In order to determine the n value, a hardware emulation/simulation may be utilized. A frequency band from 7-band to 9-band is generally sufficient as is generally used in an audio graphic equalizer. Similar to the sound retrieval system, respective frequency bands can be evenly divided into one octave. However, it can be also divided differently based upon hearing sensitivity. For example, as shown in FIG. 6, in the threshold of hearing, the sound pressure level is lowest at about 3 kHz, wherein the hearing sensitivity is highest. Therefore, more frequency bands may be assigned at this band.

The table lookup architecture 300 includes a plurality of lookup tables 310, 320 and 330 which output a plurality of left output signal pairs Lp(1,1), . . . Lp(i,j), . . . Lp(n,n) and a plurality of right output signal pairs Rp(1,1), . . .

Rp(i,j), . . . Rp(n,n) after processing the plurality of left output signals L1, L2, . . . Ln and the plurality of right output signals R1, R2, . . . Rn using predetermined parameters. The table lookup architecture 300 may carry out audio signal processing with great variety, based on the parameters predetermined in the lookup tables 310, 320 and 330.

Referring to FIG. 5 and FIG. 7, the lookup tables 320 include a memory 600 which includes a plurality of cells having six parameters, $\alpha 1'$, $\alpha 2'$, $\beta 1'$, $\beta 2'$, $\delta_L'$ and $\delta_R'$. The parameters are obtained from the corresponding cell by driving a column address line and a row address line after converting respective output signals Li and Rj from the spectrum analyzers 200 and 300 into logarithmic scales.

The lookup table 320 is a block which processes the i-th frequency band and the j-th frequency band. In FIG. 7, the left signal and the right signal input to the lookup table 320 are converted to into a logarithmic scale and the amplitude of the logarithmic scale drives row address line and column address line in the ROM respectively. The logarithmic scale is used because sound pressure level increases in multiplication whereas the human perception level increases linearly. In other words, there is a logarithmic correlation between the sound pressure level and the human perception level.

In stereophonic devices according to an embodiment of the present invention, correlation between different frequency bands are taken into consideration. It may be difficult to perform this correction in the conventional SRS.

If the whole frequency bands are to be considered, $n^2$ number of lookup table blocks may be necessary. However, it may be difficult to correct the correlation between the highest frequency band and the lowest frequency band. The following equation is derived from the symmetry of the left signal and the right signal:

$$\text{Table}(i,j)=\text{Table}(j,i),\ 1\leq i\leq n,\ 1\leq j\leq n. \tag{5}$$

Figure 8:
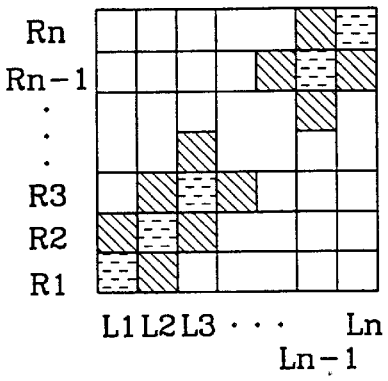
FIG. 8 is a schematic diagram illustrating the correlation of adjacent lookup tables according to an embodiment of the present invention.

As shown in equation (5), the number of lookup tables can be much less than $n^2$. When only the correlation between the same frequency bands or the neighboring frequency bands are considered, such as when the difference of i and j is not more than 1, the number of lookup tables becomes 2n−1. For example, when n=8, the number of lookup tables is 15, which becomes much less than $2^8=32$. In FIG. 8, the correlation between frequency bands of the lookup table are illustrated by darkened boxes, the number of which is 2n−1.

Referring again to FIG. 7, the interpolating system 700 includes six interpolators 710, 720, 730, 740, 750 and 760 which output interpolated parameters $\alpha 1$, $\alpha 2$, $\beta 1$, $\beta 2$, $\delta_L$ and $\delta_R$ after receiving the parameters $\alpha 1'$, $\alpha 2'$, $\beta 1'$, $\beta 2'$, $\delta_L'$ and $\delta_R'$ from the memory means 600.

The first multiplier 810 outputs the parameter $\alpha 1 \cdot Li$ after multiplying the left input signal Li and the output signal $\alpha 1$ from the first interpolator 710. The second multiplier 820 outputs the parameter $\alpha 2 \cdot Li$ after multiplying the left input signal Li and the output signal $\alpha 2$ from the second interpolator 720. The third multiplier 830 outputs the parameter $\beta 1 \cdot Rj$ after multiplying the right input signal Rj and the output signal $\beta 1$ from the fourth interpolator 740. The fourth multiplier 840 outputs the parameter $\beta 2 \cdot Rj$ after multiplying the right input signal Rj and the output signal $\beta 2$ from the fifth interpolator 750.

The first adder 910 adds the output signals from the first multiplier 810 and from the third multiplier 830. The second adder 920 adds the output signals from the second multiplier 820 and from the fourth multiplier 840. The fifth multiplier 930 outputs the right output signal pair Rp(i,j) after delaying the output time of the first adder 910 using the output signal $\delta_R$ from the sixth interpolator 760. The sixth multiplier 940 outputs the left output signal pair Lp(i,j) after delaying the output time of the first adder 920 using the output signal $\delta_L$ from the third interpolator 730.

The memory 600 is a read only memory (ROM) and there are six parameters $\alpha 1$, $\alpha 2$, $\beta 1$, $\beta 2$, $\delta_L$ and $\delta_R$ stored in each cell, the parameters being used for generating new left signals and new right signals. The relations between the new signals and parameters are expressed in the following equations:

$$Lp=\delta_L\ (\alpha 2 * Li+\beta 2 * Rj) \tag{6}$$

$$Rp=\delta_R\ (\alpha 1 * Li+\beta 1 * Rj) \tag{7}$$

where, $\alpha 1$, $\alpha 2$, $\beta 1$ and $\beta 2$ are weight parameters for determining the weight of the left input signal and the right input signal and how to combine them, and $\delta_L$ and $\delta_R$ are delay parameters for determining the delay time of the combined signals.

In the low frequency bands, sound localization is mainly achieved by the time difference of arrival at human ears, namely, by the phase difference. Therefore, the delay parameters may be used in the lookup table block where the low frequency bands are processed. However, in a high frequency band, sound localization is generally affected by sound intensity and there may be no problem if the delay parameters $\delta_L$ and $\delta_R$ for providing the phase differences are deleted.

Because the ROM data of the lookup table corresponds to specific amplitude of the left input signal and the right input signal, relative to an arbitrary amplitude, the interpolators in FIG. 7 are used for calculating the data value of neighboring cells in the ROM. Preferably, two dimensional (or plane) interpolation is used for the interpolation method.

Referring to FIG. 8, it may be necessary to determine how finely grained the amplitude of the input signals $L_{in}$ and $R_{in}$ should be. If the interval of the amplitude is too fine, the interpolators may be removed, but ROM area may need to be increased. If the interval of the amplitude is wide, not only may the interpolators be required, but also the calculated value of parameters may be inaccurate, resulting in poor quality of sound processing.

Consequently, design considerations may focus on the hardware cost versus the quality of the processing. It may be more practical to use an experimental method via hardware emulation than to rely on a qualitative method. Non-linear characteristics of hearing sensitivity can also be used, as shown in FIG. 6, by not splitting the sub-intervals evenly.

Referring again to FIG. 5, the first adder 400 outputs the final left output signal $L_{out}$ after adding the left output signal pairs Lp(1,1), . . . Lp(i,j), . . . Lp(n,n) among the output signals from a plurality of lookup tables 310, 320 and 320. The second adder 500 outputs the final right output signal $R_{out}$ after adding the left output signal pairs Rp(1,1), . . . Rp(i,j), . . . Rp(n,n) among the output signals from a plurality of lookup tables 310, 320 and 320.

Referring to FIG. 10, the processing operations of stereophonic devices according to an embodiment of the present invention will now be described: In Block S10, the left input signal and the right input signal are read, those signals being audio signals. In Block S20, frequencies of the input signals are classified into respective frequency bands by means of a spectrum analyzer and thereafter a plurality of right output signals and left output signals are output. In Block S30, table lookup is carried out to output a plurality of left output signal pairs and right output signal pairs after receiving the left output signals and the right signals from the classifying Block S20 and then interpolating by using predetermined parameters. In Block S40, left output signal pairs from the table lookup Block S30 are added to output a left output signal, and right output signal pairs from the table lookup step are added to output a right output signal.

Figure 9:
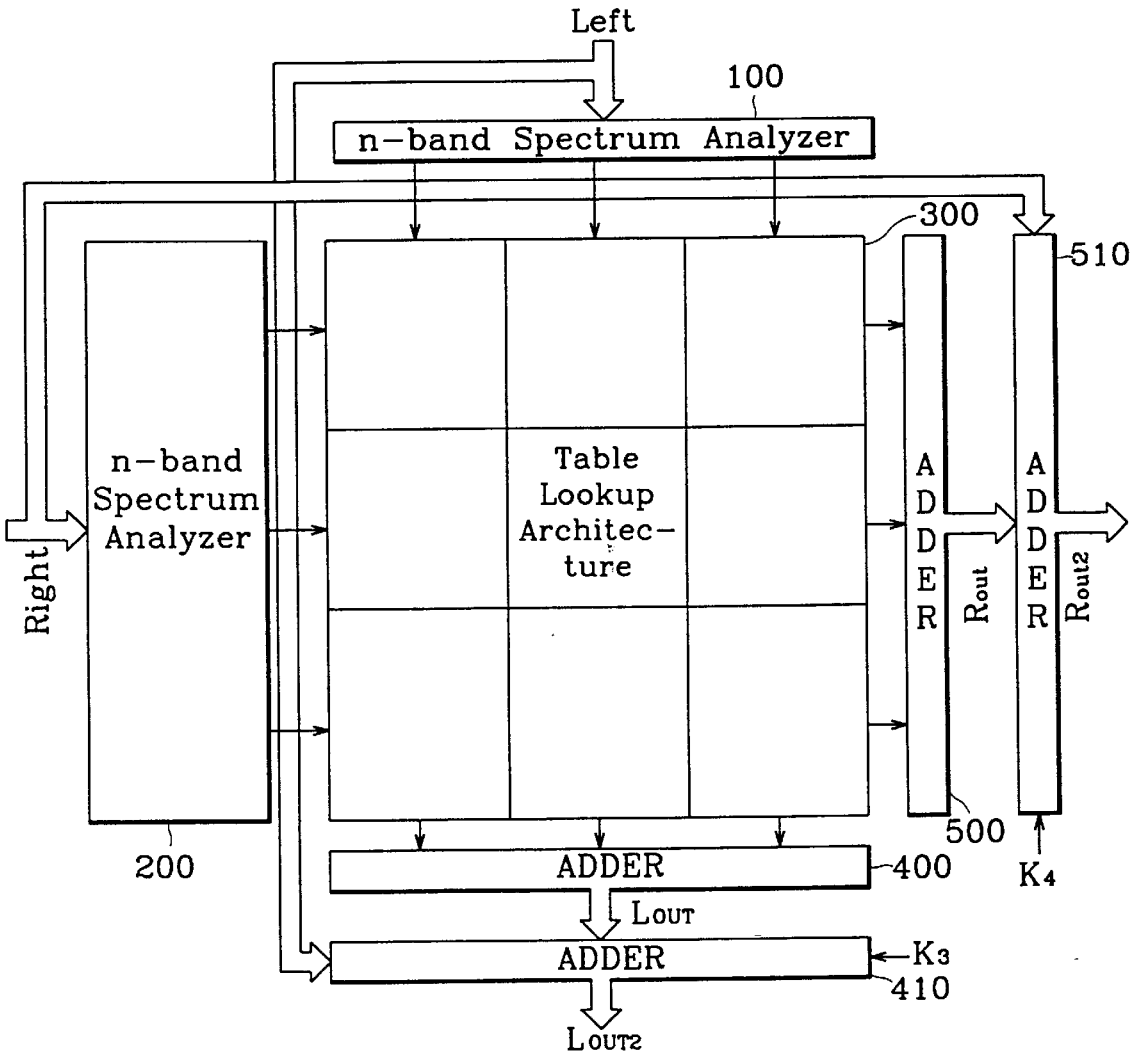
FIG. 9 is a block diagram, according to an embodiment of the present invention, illustrating a stereophonic device having a lookup table for controlling the final output signal.

Another embodiment of the present invention is shown in FIG. 9, wherein the audio input signals on both sides, left and right, are added to the final left output signal $L_{out}$ and the final right output signal $R_{out}$, both output signals shown in FIG. 5.

Referring to FIG. 9, the third adder 410 outputs the final second left output signal $L_{out2}$ after receiving the final left output signal $L_{out}$ from the first adder 400 and the left input signal Left, and then adding a predetermined ratio of the left input signal Left to the final left output signal $L_{out}$ by means of the third correction factor K3. The fourth adder 510 outputs the final second right output signal $R_{out2}$ after receiving the final right output signal $R_{out}$ from the second adder 500 and the right input signal Right, and then adding a predetermined ratio of the right input signal Right to the final right output signal $R_{out}$ by means of the fourth correction factor K4.

Accordingly, in order to achieve more substantial stereo image effect in the final output signals $L_{out}$ and $R_{out}$, a predetermined portion of the input signals are corrected by the third correction factor K3 and the fourth correction factor K4 before they are output.

According to the embodiments of the present invention as described above, a stereophonic device using a programmable table lookup architecture is provided, which enables the status or the change of an input signal to be accurately perceived and stereo image enhancement and perspective correction to be achieved reliably, to satisfy variety of users' tastes and requirements of convenience.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A stereophonic image enhancement device which processes a left input signal and a right input signal, comprising:

a first spectrum analyzer which outputs a plurality of left output signals for a corresponding plurality of frequency bands, in response to the left input signal;

a second spectrum analyzer which outputs a plurality of right output signals for a corresponding plurality of frequency bands, in response to the right input signal;

a table lookup system which is responsive to the plurality of left output signals to output a plurality of left output signal pairs, and which is responsive to the plurality of right output signals to output a plurality of right output signal pairs;

a first adder which is responsive to the plurality of left output signal pairs, to add the plurality of left output signal pairs to produce final left output signals; and a second adder which is responsive to the plurality of right output signal pairs, to add the plurality of right output signal pairs to produce final right output signals.

2. The stereophonic image enhancement device as recited in claim 1, wherein the first and second spectrum analyzers use frequency bands which are proportional to hearing sensitivity.

3. The stereophonic image enhancement device as recited in claim 2, wherein the hearing sensitivity is lowest at the frequency of 3 kHz.

4. The stereophonic image enhancement device as recited in claim 1, wherein the table lookup system includes a plurality of lookup tables which are divided in accordance with respective frequencies and are further divided into a plurality of sub-tables according to the amplitude of respective frequency bands.

5. The stereophonic image enhancement device as recited in claim 1, wherein the lookup table system comprises:

a memory which includes a plurality of row address lines and column address lines which are responsive to the plurality of right output signals and left output signals, the memory including a plurality of cells storing a plurality of parameters, the cells outputting parameters stored therein in response to the column address lines and row address lines;

an interpolator system including four interpolators which output interpolated parameters in response to the parameters which are received from the memory;

a first multiplier which multiplies the left input signal and the output interpolated parameters from the first interpolator to produce a first multiplier output;

a second multiplier which multiplies the left input signal and the output interpolated parameters from the second interpolator to produce a second multiplier output;

a third multiplier which multiplies the right input signal and the output interpolated parameters from the third interpolator to produce a third multiplier output;

a fourth multiplier which multiplies the right input signal and the output interpolated parameters from the fourth interpolator to produce a fourth multiplier output;

a first adder which adds the first multiplier output and the third multiplier output; and a second adder which adds the second multiplier output and the fourth multiplier output.

6. The stereophonic device as recited in claim 5, wherein the lookup table is responsive to user programming inputs, to assign the values of the parameters stored in the memory.

7. The stereophonic device as recited in claim 5, wherein the memory is a read only memory.

8. The stereophonic device as recited in claim 5, wherein the outputs of the interpolators are parameters which assign a weighting value to control the levels of the left input signal and the right input signal relative to the output signals.

9. The stereophonic device as recited in claim 5, wherein the interpolator system further includes a fifth interpolator and a sixth interpolator.

10. The stereophonic device as recited in claim 9 further comprising:

a fifth multiplier which multiplies an output of the sixth interpolator and an output of the first adder to produce a right output signal pair; and a sixth multiplier which multiplies an output of the fifth interpolator and an output of the second adder to produce a left output signal pair.

11. The stereophonic device as recited in claim 10, wherein the outputs from the fifth interpolator and the sixth interpolator produce delay parameters for delaying time.

12. The stereophonic device as recited in claim 11, wherein the delay parameters control the time difference of the final left output signals and the final right output signals arrival to each human ear so that sound localization may be achieved.

13. The stereophonic device as recited in claim 1, wherein the table lookup system produces parameters which are stored in an area thereof which is addressed in accordance with the frequency bands of the spectrum analyzers.

14. The stereophonic device as recited in claim 1, wherein the table lookup system is responsive to the plurality of left and right output signals in accordance with a logarithmic correlation between sound pressure level and perception level.

15. The stereophonic device as recited in claim 1, wherein the lookup table system is responsive to a selected one of the left output signals and the right output signals in a same frequency band.

16. The stereophonic device as recited in claim 1, wherein the lookup table system is responsive to selected ones of the left output signals and the right output signals in a same frequency band and in frequency bands which are adjacent the same frequency band.

17. The stereophonic device as recited in claim 1 further comprising:

a third adder which is responsive to the final left output signals from the first adder and to the left input signal, to add a predetermined ratio of the left input signal to the final left output signals; and a fourth adder which is responsive to the final right output signals from the second adder and to the right input signal, to add a predetermined ratio of the right input signal to the final right output signals.

18. A method for enhancing a stereophonic image from left and right input audio signals, comprising the steps of:

spectrum analyzing the left and right input audio signals to generate a plurality of right output signals and left output signals in a plurality of frequency bands;

performing a table lookup to obtain a plurality of left output signal pairs and right output signal pairs, using the left output signals and the right output signals to address the table, the left output signal pairs and the right output signal pairs comprising weight parameters and delay parameters; and adding the left output signal pairs to produce a final left output signal, and adding the right output signal pairs to produce a final right output signal.

19. A stereophonic image enhancement device which processes a left input signal and a right input signal, comprising:

a first spectrum analyzer which outputs a plurality of left output signals for a corresponding plurality of frequency bands, in response to the left input signal;

a second spectrum analyzer which outputs a plurality of right output signals for a corresponding plurality of frequency bands, in response to the right input signal;

a table lookup system which is responsive to the plurality of left output signals to output a plurality of intermediate left output signals, and which is responsive to the plurality of right output signals to output a plurality of intermediate right output signals;

a first combiner which is responsive to the plurality of intermediate left output signals, to combine the plurality of intermediate left output signals to produce final left output signals; and a second combiner which is responsive to the plurality of intermediate right output signals, to combine the plurality of intermediate right output signals to produce final right output signals.

* * * * *